US008136308B2

(12) United States Patent
Slott et al.

(10) Patent No.: US 8,136,308 B2
(45) Date of Patent: Mar. 20, 2012

(54) WEDGE SET, ESPECIALLY FOR USE IN FASTENING FLOOR JOISTS

(75) Inventors: Ole Slott, Værløse (DK); Thomas Flindt, Tureby (DK)

(73) Assignee: Junckers Industrier A/S, Koge (DK)

( * ) Notice: Subject to any disclaimer, the term of this patent is extended or adjusted under 35 U.S.C. 154(b) by 125 days.

(21) Appl. No.: 12/733,131

(22) PCT Filed: Aug. 15, 2008

(86) PCT No.: PCT/DK2008/000288

§ 371 (c)(1),
(2), (4) Date: Feb. 12, 2010

(87) PCT Pub. No.: WO2009/021516

PCT Pub. Date: Feb. 19, 2009

(65) Prior Publication Data

US 2010/0139199 A1 Jun. 10, 2010

(30) Foreign Application Priority Data

Aug. 16, 2007 (DK) ..... 2007 01170

(51) Int. Cl.

| | |
|---|---|
| ***B66F 11/00*** | (2006.01) |
| ***E02D 35/00*** | (2006.01) |
| ***F16M 7/00*** | (2006.01) |
| ***E04F 21/20*** | (2006.01) |

(52) U.S. Cl. ..... 52/126.1; 52/126.5; 248/188.2; 254/104

(58) Field of Classification Search ..... 52/126.1, 52/126.5; 248/188.2, 188.5; 254/104
See application file for complete search history.

(56) References Cited

U.S. PATENT DOCUMENTS

| | | | | |
|---|---|---|---|---|
| 464,921 | A * | 12/1891 | Carr | 405/1 |
| 1,045,984 | A * | 12/1912 | King | 254/104 |
| 1,335,247 | A * | 3/1920 | Lask | 269/310 |
| 1,556,584 | A * | 10/1925 | Breeden | 254/104 |
| 2,539,703 | A | 1/1951 | Sato | |
| 2,651,814 | A * | 9/1953 | Lester, Jr. | 49/380 |
| 2,709,571 | A * | 5/1955 | Mafera | 254/104 |
| 3,171,632 | A * | 3/1965 | Jines | 254/104 |
| 3,836,118 | A | 9/1974 | Meyer | |
| 4,281,739 | A * | 8/1981 | Keiser | 181/207 |

(Continued)

FOREIGN PATENT DOCUMENTS

DE 297 07 500 U1 7/1998

(Continued)

*Primary Examiner* — Robert Canfield
(74) *Attorney, Agent, or Firm* — The Nath Law Group; Jerald L. Meyer; Robert T. Burns

(57) ABSTRACT

A wedge set for use in fastening floor joists consists of two interslidable wedge members (1, 2) adapted to abut each other along cooperating first abutment surfaces (3, 10), each wedge member (1, 2) having a second abutment surface (4, 11) forming an acute angle with the corresponding first abutment surface. The second abutment surfaces (4, 11) on the two wedge members (1, 2) of the wedge set extend substantially parallel to each other. The wedge members (1, 2) have cooperating locking means (6, 7, 13, 14), which are adapted for retaining them from a mutual displacement so that the distance between their second abutment surfaces (4, 11) is reduced, and retaining means (9, 15), which are adapted for retaining the first abutment surfaces (3, 10) in abutment with each other. The first abutment surfaces (3, 10) are plane and the locking means (6) consist of ratchets.

12 Claims, 2 Drawing Sheets

U.S. PATENT DOCUMENTS

| | | | | |
|---|---|---|---|---|
| 4,776,548 | A | 10/1988 | Bezenek | |
| 4,838,515 | A * | 6/1989 | Prentice | 248/661 |
| 5,331,754 | A * | 7/1994 | Ruvang | 37/457 |
| 6,018,916 | A * | 2/2000 | Henry | 52/126.1 |
| 7,357,364 | B2 * | 4/2008 | Jackson et al. | 248/309.1 |
| 7,703,727 | B2 * | 4/2010 | Selness | 248/188.2 |

FOREIGN PATENT DOCUMENTS

| | | | |
|---|---|---|---|
| DK | 119575 | B | 1/1971 |
| GB | 2 404 388 | A | 2/2005 |
| WO | 02/079654 | A1 | 10/2002 |
| WO | 2005/033436 | A1 | 4/2005 |

* cited by examiner

WEDGE SET, ESPECIALLY FOR USE IN FASTENING FLOOR JOISTS

This is a National Phase Application filed under 35 USC 371 of International Application No. PCT/DK2008/000288, filed on Aug. 15, 2008, which claims foreign priority benefits under 35 USC 119 of Danish Application No. PA 2007 01170, filed on Aug. 16, 2007, the content of each of which is hereby incorporated herein by reference in its entirety.

TECHNICAL FIELD

The invention relates to a wedge set, especially for use in fastening floor joists, said wedge set consisting of two wedge members adapted to abut each other along cooperating first abutment surfaces, each wedge member having a second abutment surface forming an acute angle with the corresponding first abutment surface, where the second abutment surfaces on the two wedge members of the wedge set extend substantially parallel to each other, and where the wedge members have cooperating locking means, which are adapted for retaining them from a mutual displacement so that the distance between their second abutment surfaces is reduced, and retaining means, which are adapted for retaining the first abutment surfaces in abutment with each other.

BACKGROUND

It is known that wedge members in wedge sets of this type include cooperating rows of teeth on their first abutment surface. These rows of teeth includes such a jagged-like form that the wedge elements are easily displaced in a direction, where the distance between their second abutment surfaces is increased, and are restrained from displacement in the opposite direction. By this it is relatively easy to adjust the distance between the second abutment surfaces of the wedge members. Such wedge member is disclosed in e.g. GB 2 404 388. In addition to the first abutment surface of the wedge members there are longitudinal grooves and ribs with a dovetail-formed cross section in the wedge set according to said patent specification. By this the wedge elements are retained in engagement with each other so that they cannot be pulled away from each other in a direction perpendicular on their second abutment surface.

DISCLOSURE OF THE INVENTION

The object of the invention is to provide a wedge set enabling a uniform displacement of the wedge members in relation to each other and mutual retainment without use of additional fastening means, such as nails or the like.

This is achieved because the wedge set of the initially mentioned type is characterised in that the first abutment surfaces are plane and in that the locking means consist of ratchets.

The achievement of the uniform displacement is due to the plane first abutment surfaces gliding smoothly over each other, while the locking is achieved by ratchets, the teeth of which on the first wedge member easily passes the latches or pawls on the second wedge member. By this, it is ensured that the height, viz. the distance between the second abutment surfaces, is relatively easily adjusted without having to overcome the resistance from transverse interlocking teeth. At the same time it is rendered unnecessary having to fasten the wedge members to each other by way of nails. This is due to the fact that the pawls remains engaged with the teeth, regardless of whether the wedge members are subjected to an external stress.

Preferably, according to the invention the ratchets may comprise a rib with teeth on the first abutment surface of the first wedge member and a number of cooperating pawls, which are formed in association with a groove in the second wedge member.

According to the invention the rib may have a substantially rectangular cross section, and there are teeth on both sides of the rib. This ensures that the mutual displacement of the wedge elements is especially uniform, as the ratchet pawls perform their displacement parallel to the first abutment surfaces.

Preferably, according to the invention the retaining means may be dovetail-formed means.

According to the invention the dovetail-formed means may be formed by webs sloping towards each other and extending parallel to the rib or the groove on each their side of the plane abutment surface of one of the wedge members, and corresponding projections, which are formed along the sides of the other wedge member. By this it is achieved that the retaining means are especially easy to produce.

Further, according to the invention the first wedge member in abutment with the second abutment surface may have means for locking the floor joist to be carried by this. By this it is achieved that joists and wedge sets may be connected with no use of other parts, such as nails, screws or staples.

According to the invention, the said locking means may comprise upwardly protruding parts along the sides of the second abutment surface, where the upwardly protruding parts are raised edges along two opposite sides, and the other two upwardly protruding parts are raised edges with inwardly protruding webs along the upper free edges, and one of the upwardly protruding parts with inwardly protruding webs is flexible. This enables especially easy and stable connecting with a locking means of the type described in WO 2005/033436, and which is adapted to interlock with a rubber member fastened to a joist.

Finally, the flexible edge may comprise an outwardly protruding activation flap along the upper free edge. This enables easy disengaging of the engagement with a locking means.

BRIEF DESCRIPTION OF THE DRAWING

The invention is explained in detail below with reference to the drawing, in which.

DETAILED DESCRIPTION OF THE INVENTION

Figure 1:
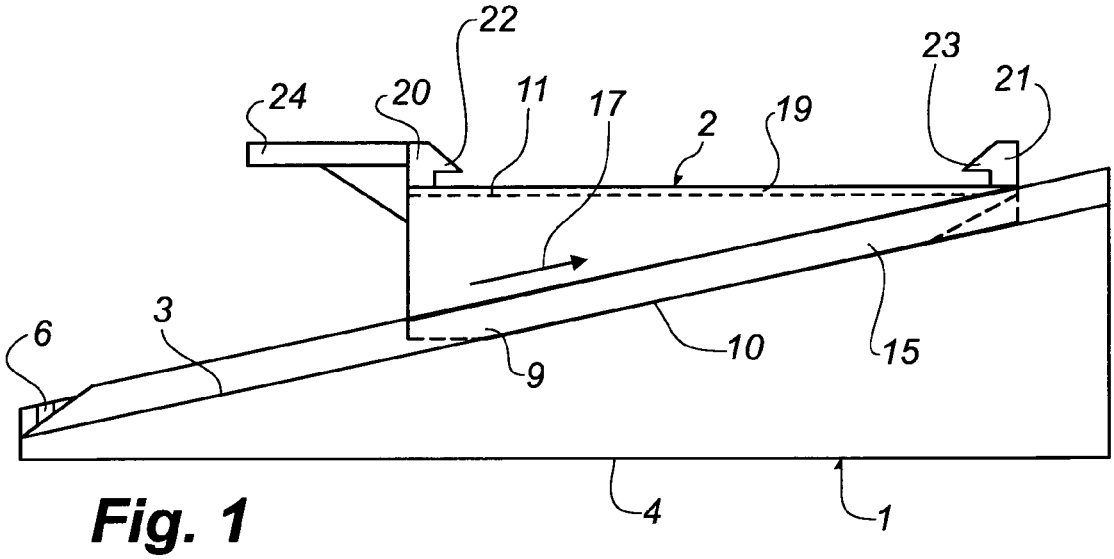
FIG. 1 shows a wedge set according to the invention, seen from the side.
Figure 2:
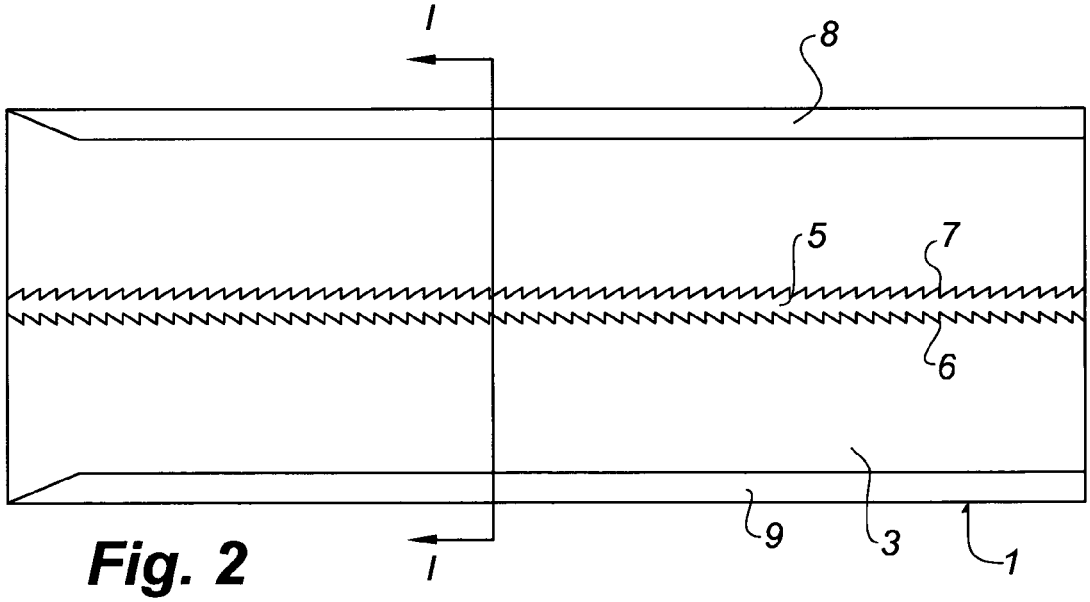
FIG. 2 shows the first wedge member shown in FIG. 1, seen from above.
Figure 3:
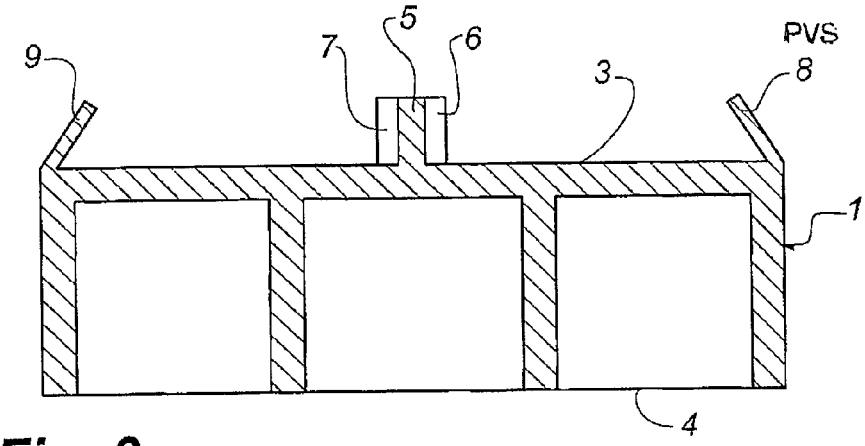
FIG. 3 shows the wedge member shown in FIG. 2, seen as a sectional view after the line I-I.

The wedge set shown in FIG. 1 comprises two wedge members, a first one of which is shown by the general reference number 1 and a second is shown by the general reference number 2. The first wedge member 1 has a first abutment surface 3 and a third abutment surface 4. The first abutment surface is indicated with the reference number 3 in FIG. 1, but is only shown in FIGS. 2 and 3. The first abutment surface 3 is planar, and an upwardly protruding rib 5 is formed centrally on said first abutment surface 3, said upwardly protruding rib 5 having a substantially rectangular cross section and a number of jagged-like teeth 6 and 7 on their side.

Further, the first wedge member 1 has sloping webs 8, 9 (also referred to as longitudinal webs 8 and 9) formed along each their side of the first abutment surface 3 parallel with the rib 5. These webs 8 and 9 slope towards each other.

Figure 4:
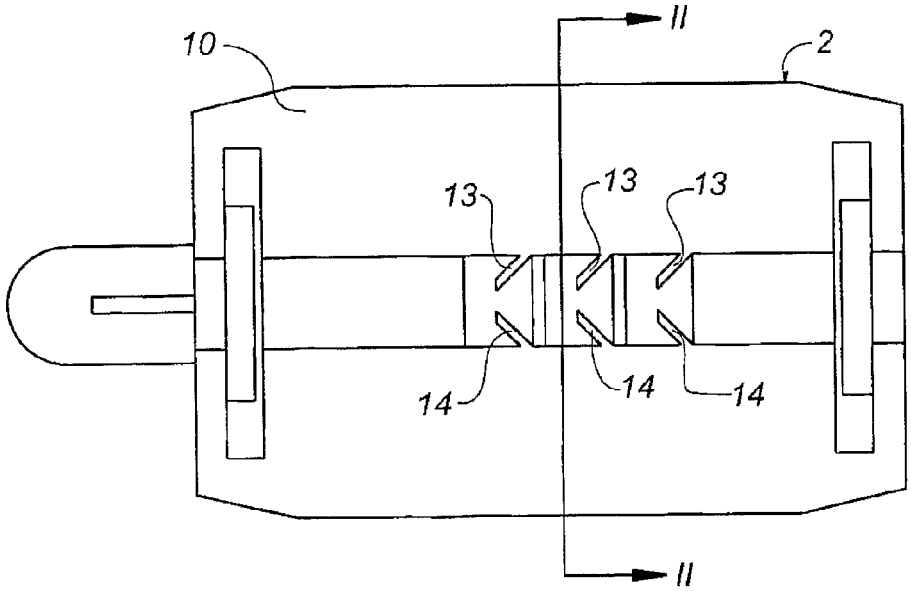
FIG. 4 shows the second wedge element shown in FIG. 1, seen from below.
Figure 5:
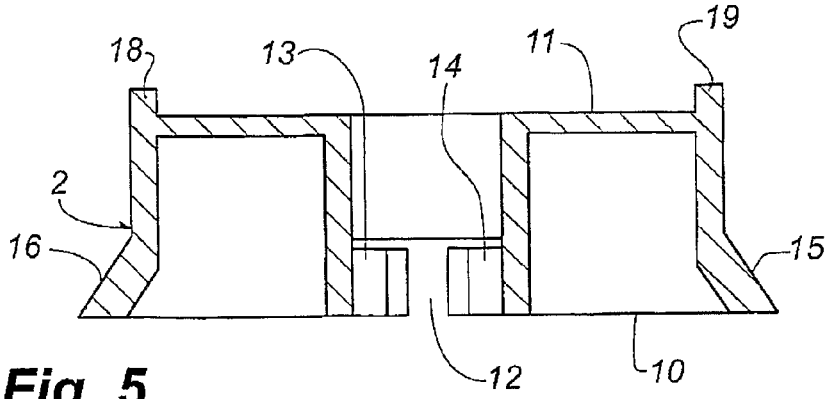
FIG. 5 shows the wedge element shown in FIG. 4, seen as a sectional view after the line II-II.

The second wedge member 2 has a second abutment surface 10 and a fourth abutment surface 11. The second abutment surface 10 is indicated in FIG. 1 but is actually only shown in FIGS. 4 and 5. Centrally on the second abutment surface 10 of the second wedge member 2 there is a longitudinal slot or groove 12, on both sides of which flexible pawls or latches 13, 14 are formed. In addition, the second wedge member 2 is formed with outwardly protruding projections 15, 16 along each side of the second abutment surface. As is evident from FIG. 5, said projections have a sloping side and are formed symmetrically.

When using the two wedge members 1, 2 they engage with each other, so that the longitudinal webs 8, 9 of the first wedge member 1 interlock over the outwardly protruding projection 15, 16 of the second wedge member 2. By this, the first and second abutment surfaces 3, 10 of the two wedge members 1, 2 abut each other flatly. Simultaneously, the rib 5 of the first wedge member 1 interlocks centrally in the groove 12 of the second wedge member 2, whereby the teeth 6, 7 on the first wedge member interlock in cooperation with the pawls 13, 14 in the groove 12 of the second wedge member 2. The teeth 7, 6 and the pawls 13, 14 are formed in order to cooperate like ratchets so that the two wedge members 1, 2 are easily displaced mutually in one direction but are restrained from displacement in the opposite direction. In FIG. 1 the displacement direction is shown by the arrow 17, which is the direction in which the second wedge member 2 can be displaced in relation to the first wedge member 1, so that the distance between the third and fourth abutment surfaces 4, 11 of the two wedge members 1, 2 may be increased and adjusted to the desired length in an ordinarily known way. Each of the wedge members 1 and 2 are cast in appropriate plastic material with varying hollowness in order to reduce the weight and material consumption.

As is evident from the drawing, the second wedge member 2 is formed with upwardly protruding parts along the sides of the fourth abutment surface 11. This way, raised edges 18, 19 (see FIG. 5) are formed on the two longitudinal opposite sides, while raised edges 20, 21 (see FIG. 1) are formed on the two other sides, said raised edges 20, 21 each having an inwardly protruding web 22, 23 with a sloping upper side. At least one of the two latter raised edges 20, 21 is formed so as to be lightly flexible, and one of them 20 is formed with a protruding activation flap 24 in order to facilitate an outward bending of the raised edge 20 by pressing the activation flap. By appropriate dimensioning, the second wedge member 2 is thus adapted to interlock with a locking means (not shown), which has a sheet-shaped basis part, and which is in an ordinarily known way adapted to interlock with an appropriate rubber member (not shown) on a joist. This way, the wedge set is especially suitable for use in connection with fastening floor joists.

The wedge members slide easily over each other along the plane wedge surfaces and the use of ratchets for ensuring the locking also means that the displacement of the wedge members in relation to each other takes place relatively easily without having to overcome particularly heavy forces. The use of such wedge sets implies that the floor joists can be laid down without using tools, as there is no need for nails for connecting the wedge members with each other and with the joists. This also reduces the sound in connection with traffic on the floors in question. Finally, the guarantee for durability over a long period is increased, as there is no occurrence of incorrect nailing of the wedge members and thereby the risk that in time the fastening will break.

The invention has been described with reference to one particular embodiment. Many changes may be made without deviating from the scope of the present invention. For instance, the wedge members may be formed in various sizes depending on the use. Further, the second wedge member 2 may be adapted so as to interlock with a corresponding member, which is already fastened directly to a joist. The preferred embodiment has three sets of pawls (13, 14). Naturally, another appropriate number of pawls (13, 14) may be used.

The invention claimed is:

1. Wedge set, comprising:

first and second interslidable wedges adapted to abut each other along cooperating first and second abutment surfaces respectively;

third and fourth abutment surfaces extending substantially parallel to each other and respectively forming first and second acute angles with the first and second abutment surfaces;

a rib attached to the first abutment surface;

a groove formed on the second abutment surface;

a plurality of teeth formed on opposing sides of the rib and a plurality of pawls formed on opposing sides of the groove, the teeth and pawls being adapted for retaining the first and second wedges in a mutual displacement so that the distance between the third and fourth abutment surfaces is reduced; and first and second longitudinal webs on opposing sides of the first abutment surface and first and second outwardly protruding projections on opposing sides of the second abutment surface, the first and second longitudinal webs and the first and second outwardly protruding projections adapted for retaining the first and second abutment surfaces in abutment with each other, wherein the teeth and pawls form a plurality of ratchets.

2. Wedge set according to claim 1, wherein the rib has a substantially rectangular cross section.

3. Wedge set according to claim 1, wherein the first and second longitudinal webs respectively dovetail with the first and second outwardly protruding projections.

4. Wedge set according to claim 3, wherein:

the first and second longitudinal webs slope towards each other and extend parallel to the rib on opposing sides of the first abutment surface, and interlock over the first and second outwardly protruding projections of the second abutment surface.

5. Wedge set according to claim 1, comprising:

first and second upwardly protruding parts along opposing first and second sides of the fourth abutment surface;

third and fourth upwardly protruding parts along opposing third and fourth sides of the fourth abutment surface; and third and fourth webs inwardly protruding from first and second upper edges of the third and fourth upwardly protruding parts, wherein at least one of the third and fourth upwardly protruding parts is flexible.

6. Wedge set according to claim 5, further comprising an outwardly protruding activation flap along an edge opposite the third or fourth inwardly protruding web of the flexible third or fourth upwardly protruding part.

7. Wedge set, comprising:

first and second interslidable wedges adapted to abut each other along cooperating first and second abutment surfaces respectively;

third and fourth abutment surfaces extending substantially parallel to each other and respectively forming first and second acute angles with the first and second abutment surfaces;

a rib attached to the first abutment surface;

a groove formed on the second abutment surface;

a plurality of teeth formed on opposing sides of the rib and a plurality of pawls formed on opposing sides of the groove, the teeth and pawls being adapted for retaining the first and second wedges in a mutual displacement so that the distance between the third and fourth abutment surfaces is reduced;

first and second outwardly protruding projections on opposing sides of the first abutment surface and first and second longitudinal webs on opposing sides of the second abutment surface, the first and second outwardly protruding projections and the first and second longitudinal webs adapted for retaining the first and second abutment surfaces in abutment with each other, wherein the teeth and pawls form a plurality of ratchets.

8. Wedge set according to claim 7, wherein the rib has a substantially rectangular cross section.

9. Wedge set according to claim 7, wherein the first and second longitudinal webs respectively dovetail with the first and second outwardly protruding projections.

10. Wedge set according to claim 9, wherein:

the first and second longitudinal webs slope towards each other and extend parallel to the rib on opposing sides of the second abutment surface, and interlock over the first and second outwardly protruding projections of the first abutment surface.

11. Wedge set according to claim 9, further comprising:

first and second upwardly protruding parts along opposing first and second sides of the fourth abutment surface;

third and fourth upwardly protruding parts along opposing third and fourth sides of the fourth abutment surface; and third and fourth webs inwardly protruding from first and second upper edges of the third and fourth upwardly protruding parts, wherein at least one of the third and fourth upwardly protruding parts is flexible.

12. Wedge set according to claim 11, further comprising an outwardly protruding activation flap along an edge opposite the third or fourth inwardly protruding web of the flexible third or fourth upwardly protruding part.

* * * * *